US010858129B2

(12) United States Patent
Day et al.

(10) Patent No.: US 10,858,129 B2
(45) Date of Patent: Dec. 8, 2020

(54) FOOD STORAGE APPLIANCE

(71) Applicant: Sunbeam Products, Inc., Boca Raton, FL (US)

(72) Inventors: Adam Day, Boynton Beach, FL (US); Jason Harris, Boca Raton, FL (US); David Owens, Boynton Beach, FL (US); Justin Cumming, Arlington, MA (US); Yee Chu Wong, Wong Chuk Hang (HK); Kenneth Young, San Francisco, CA (US)

(73) Assignee: Sunbeam Products, Inc., Boca Raton, FL (US)

( * ) Notice: Subject to any disclaimer, the term of this patent is extended or adjusted under 35 U.S.C. 154(b) by 344 days.

(21) Appl. No.: 15/579,727

(22) PCT Filed: Jun. 6, 2016

(86) PCT No.: PCT/US2016/036072
§ 371 (c)(1),
(2) Date: Dec. 5, 2017

(87) PCT Pub. No.: WO2016/197134
PCT Pub. Date: Dec. 8, 2016

(65) Prior Publication Data

US 2018/0162569 A1 Jun. 14, 2018

Related U.S. Application Data

(60) Provisional application No. 62/171,496, filed on Jun. 5, 2015.

(51) Int. Cl.
*B65B 25/00* (2006.01)
*B65B 61/06* (2006.01)
(Continued)

(52) U.S. Cl.
CPC ..... *B65B 25/001* (2013.01); *B65B 31/024* (2013.01); *B65B 41/12* (2013.01);
(Continued)

(58) Field of Classification Search
CPC ..... B65B 25/001; B65B 7/02; B65B 7/06; B65B 31/04; B65B 31/043; B65B 31/048;
(Continued)

(56) References Cited

U.S. PATENT DOCUMENTS 3,764,434 A * 10/1973 Bridenstine ..... B29C 66/861 156/251
5,682,727 A * 11/1997 Harte ..... B65B 31/024 53/434

(Continued)

*Primary Examiner* — Dariush Seif
(74) *Attorney, Agent, or Firm* — Husch Blackwell LLP

(57) ABSTRACT

A food storage appliance is provided including a housing containing operative components of the food storage appliance. There is a first heat sealing element disposed on a lower portion of the housing configured to heat seal a first end of a section of food storage container material forming a food storage container unsealed at a second end. A vacuum chamber is disposed in an upper portion of the housing connected to a source of suction. A second heat sealing element is disposed in the upper portion of the housing adjacent to the vacuum chamber configured to heat seal the second end of the food storage container after being inserted into the vacuum chamber and being evacuated by suction from the suction source.

18 Claims, 10 Drawing Sheets

(51) Int. Cl.
*B65B 31/02* (2006.01)
*B65B 41/12* (2006.01)
*B65B 51/30* (2006.01)

(52) U.S. Cl.
CPC ..... *B65B 51/30* (2013.01); *B65B 61/06* (2013.01); *B65B 31/028* (2013.01)

(58) Field of Classification Search
CPC ..... B65B 31/06; B65B 31/024; B65B 31/028; B65B 41/12; B65B 43/12; B65B 43/123; B65B 43/14; B65B 43/22; B65B 51/146; B65B 51/30; B65B 61/06
USPC ..... 53/510, 512, 79, 374.8, 374.9, 389.2, 53/389.3
See application file for complete search history.

(56) References Cited

U.S. PATENT DOCUMENTS 5,858,164 A * 1/1999 Panjwani ..... B29C 66/93451 156/359
6,694,710 B2 * 2/2004 Wang ..... B65B 31/06 53/427
7,000,369 B1 * 2/2006 Paviot ..... B65B 9/13 493/189
7,454,884 B2 * 11/2008 Kahn ..... B65B 31/046 53/374.9
10,040,589 B2 * 8/2018 Owens ..... B65B 31/024
2004/0031245 A1 * 2/2004 Kingeter ..... B65B 31/02 53/510
2004/0060262 A1 * 4/2004 Harges ..... B29C 65/18 53/434
2004/0065051 A1 * 4/2004 Patterson ..... B65B 31/06 53/432
2005/0011166 A1 * 1/2005 Germano ..... B65B 31/024 53/512
2005/0039420 A1 * 2/2005 Albritton ..... B65B 31/00 53/432
2005/0044814 A1 * 3/2005 Patterson ..... B65B 31/06 53/432
2005/0205455 A1 * 9/2005 Harrison ..... B65B 31/046 206/524.8
2006/0137299 A1 * 6/2006 Huang ..... B29C 65/18 53/512
2006/0230711 A1 * 10/2006 Higer ..... B65B 31/048 53/512
2006/0254219 A1 * 11/2006 Alipour ..... B29C 65/18 53/434
2007/0039288 A1 * 2/2007 Clarke ..... B65B 31/08 53/434
2009/0255221 A1 * 10/2009 Lyman, Jr. ..... B65B 31/046 53/512
2010/0095638 A1 * 4/2010 Zakowski ..... B65B 31/046 53/433
2012/0060447 A1 * 3/2012 Liu ..... B65B 31/048 53/434
2012/0090281 A1 * 4/2012 Abate ..... B65B 31/046 53/510
2013/0097967 A1 * 4/2013 Picozza ..... B65B 51/146 53/408
2014/0102051 A1 * 4/2014 Huang ..... B65B 31/048 53/512
2014/0116003 A1 * 5/2014 Hammad ..... B65B 7/06 53/376.3
2014/0345236 A1 * 11/2014 Diaz ..... B65B 59/00 53/479
2015/0027089 A1 * 1/2015 Owens ..... B29C 66/8324 53/510
2015/0052850 A1 * 2/2015 Rausch ..... B65B 31/024 53/405
2015/0259122 A1 * 9/2015 Parker ..... B65D 51/1644 206/205

* cited by examiner

FOOD STORAGE APPLIANCE

CROSS REFERENCE TO RELATED APPLICATIONS

This application is a U.S. National Phase Application of International Application No. PCT/US2016/036072 filed on Jun. 6, 2016; said application claims priority to and benefit of U.S. Provisional Patent Application No. 62/171,496 filed Jun. 5, 2015, entitled "Food Sealer". The disclosures of International Application No. PCT/US2016/036072 and U.S. Provisional Patent Application No. 62/171,496 are incorporated herein by reference.

FIELD OF THE INVENTION

The invention relates to food preservation, and more particularly, to an improved food storage appliance with reduced steps for forming, evacuating and heat sealing a flexible food storage container containing a perishable item.

BACKGROUND OF THE INVENTION

Food storage appliances that evacuate air from containers holding food are becoming increasingly popular with households for food preservation and storage. The removal of the air delays spoilage and extends the life of the food. The appliances are typically used in conjunction with a flexible bag material that constitutes the container holding the food. After the food is inserted in the storage container, the storage container is evacuated and fully sealed by applying heat and pressure to the remaining cut edge. Many food storage appliances attempt to automate the formation of the food storage container from a roll of flexible food storage material and then evacuate and heat seal but still these appliances don't fully automate the process.

SUMMARY OF THE INVENTION

In an aspect of the invention, there is provide a food storage appliance including a housing containing operative components of the food storage appliance, a first heat sealing element on a lower portion of the housing configured to heat seal a first end of a section of food storage container material forming a food storage container unsealed at a second end, a vacuum chamber disposed in an upper portion of the housing connected to a vacuum-motor assembly, and a second heat sealing element in the upper portion of the housing disposed adjacent to the vacuum chamber configured to heat seal the second end of the food storage container after being inserted into the vacuum chamber and being evacuated by suction from the vacuum-motor assembly.

In another aspect of the invention, there is provided a food storage appliance including a housing, a vacuum chamber, a vacuum-motor assembly fluidly connected to the vacuum chamber for providing suction to the vacuum chamber when energized, a lid movable between an open position and a closed position covering and sealing the vacuum chamber when the vacuum-motor assembly is energized, and at least one pneumatically activated cylinder connected to exhaust tubing of the vacuum-motor assembly. The cylinder includes a sliding rod that is extended when pressurized air from the exhaust tubing is applied to the cylinder and the sliding rod engaging a latch member on the lid drawing and locking the lid over the vacuum chamber to seal the vacuum chamber.

In another aspect of the invention, there is provided a food storage appliance including a housing, a vacuum chamber, and a transparent lid pivotally mounted to the housing, the lid movable between an open position to insert a portion of a food storage container into the vacuum chamber and a closed position to seal the vacuum chamber facilitating evacuating the food storage container.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
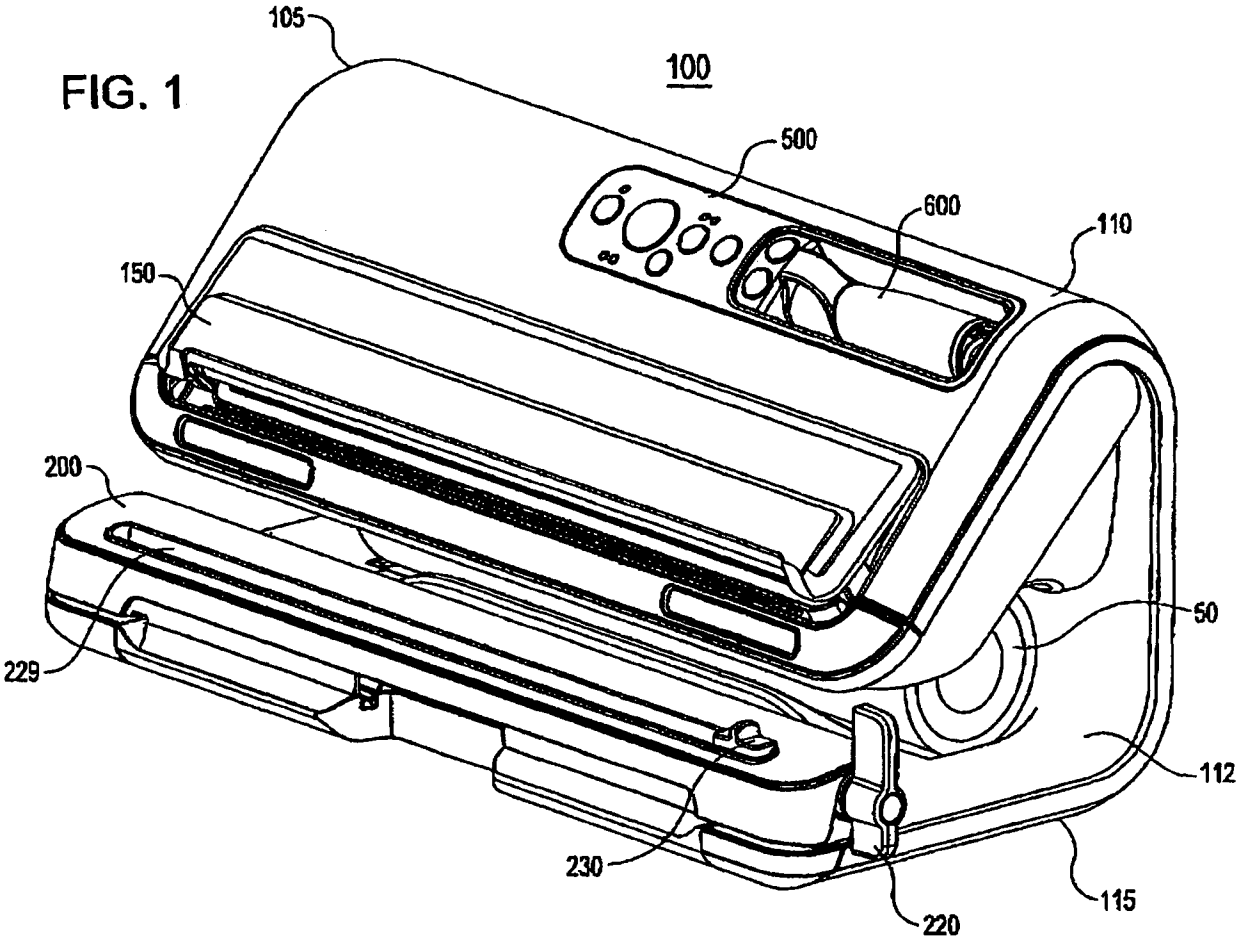
FIG. 1 is a perspective view of an embodiment of a food storage appliance with an open cavity for receiving a roll of food storage container material.
Figure 2:
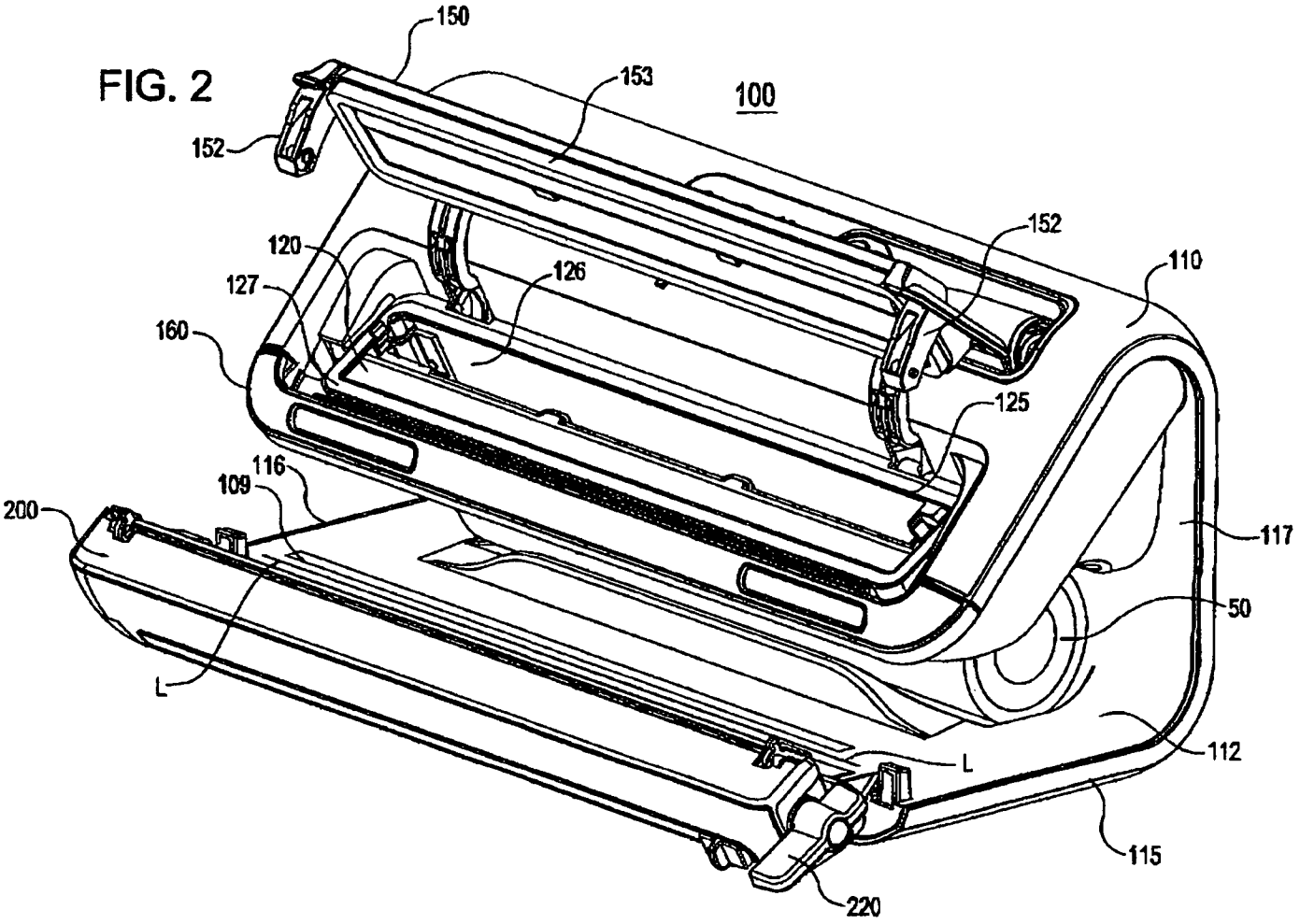
FIG. 2 is another perspective view of the food storage appliance of FIG. 1 with a transparent lid in an open position illustrating a vacuum chamber with a removable drip tray and a double-hinged cutter bar assembly on a lower housing in an open position.
Figure 3:
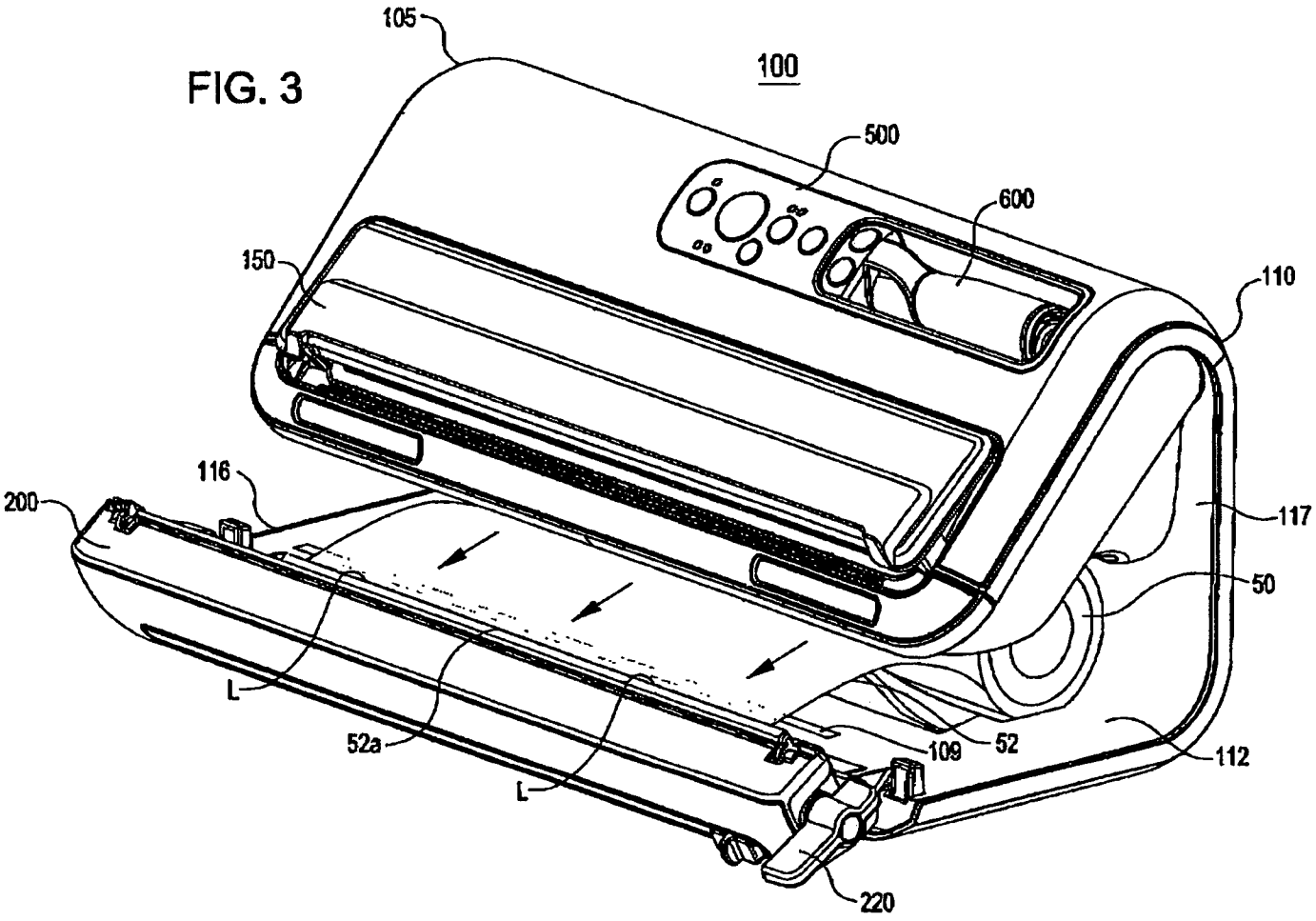
FIG. 3 is another perspective view of the food storage appliance of FIG. 2 with the lid in a partially closed position and the double-hinged cutter bar in the open position so that a section of food storage material can be extended from the roll of container material within the cavity and the free end sealed by a first heat sealing element.

Referring now to FIGS. 1-2 of the drawings, there is illustrated an embodiment of a food storage appliance 100 which includes a housing 105 having an upper housing assembly 110 affixed cantilever style to a lower housing assembly 115. The lower housing assembly 115 includes a substantially planar horizontal portion 116 for resting on a horizontal surface. The lower housing assembly 115 further includes a substantially planar vertical portion 117 having a lower edge affixed to the horizontal portion 116 in a perpendicular manner. The upper housing assembly 110 is affixed to an upper edge of the vertical portion 117 in a cantilever fashion. The upper housing assembly 110 and the lower housing assembly 115 together form a cavity 112 for holding and storing a roll of flexible food storage container material 50. The roll 50 may be inserted into the cavity 112 through an opening on either end of the cavity 112. The roll 50 forms a supply of food storage container material that may be unrolled as needed to form multiple flexible food storage containers that are heat sealed on a first end 52*a* (see also FIG. 3) before a section of the material is cut from the roll 50 to form a single food storage container 52 with an unsealed second end 52*b* (see also FIG. 5). Perishable food items may then be inserted into the food storage container 52 through the unsealed second end 52*b* prior to the unsealed second end 52*b* being inserted into a vacuum chamber 125 formed in the upper housing assembly 110. The food storage container 52 may then be evacuated of liquids and food spoiling oxygen followed by heat sealing the second end 52*b* to form a hermitically sealed container as described herein.

Figure 7:
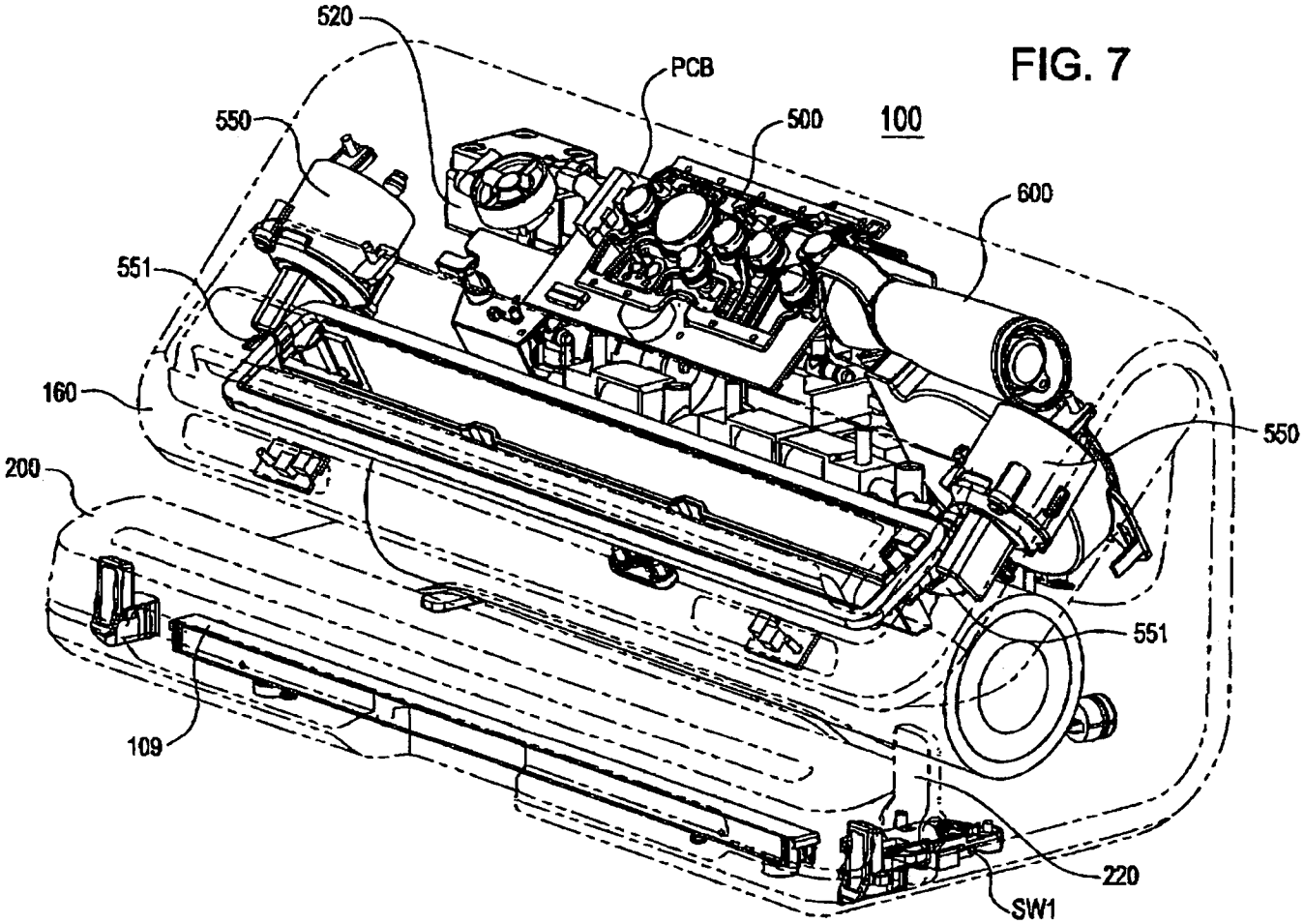
FIG. 7 is another perspective view of the food storage appliance of FIGS. 1-5 with the housing in phantom illustrating the interior electronical and mechanical components thereof.
Figure 8:
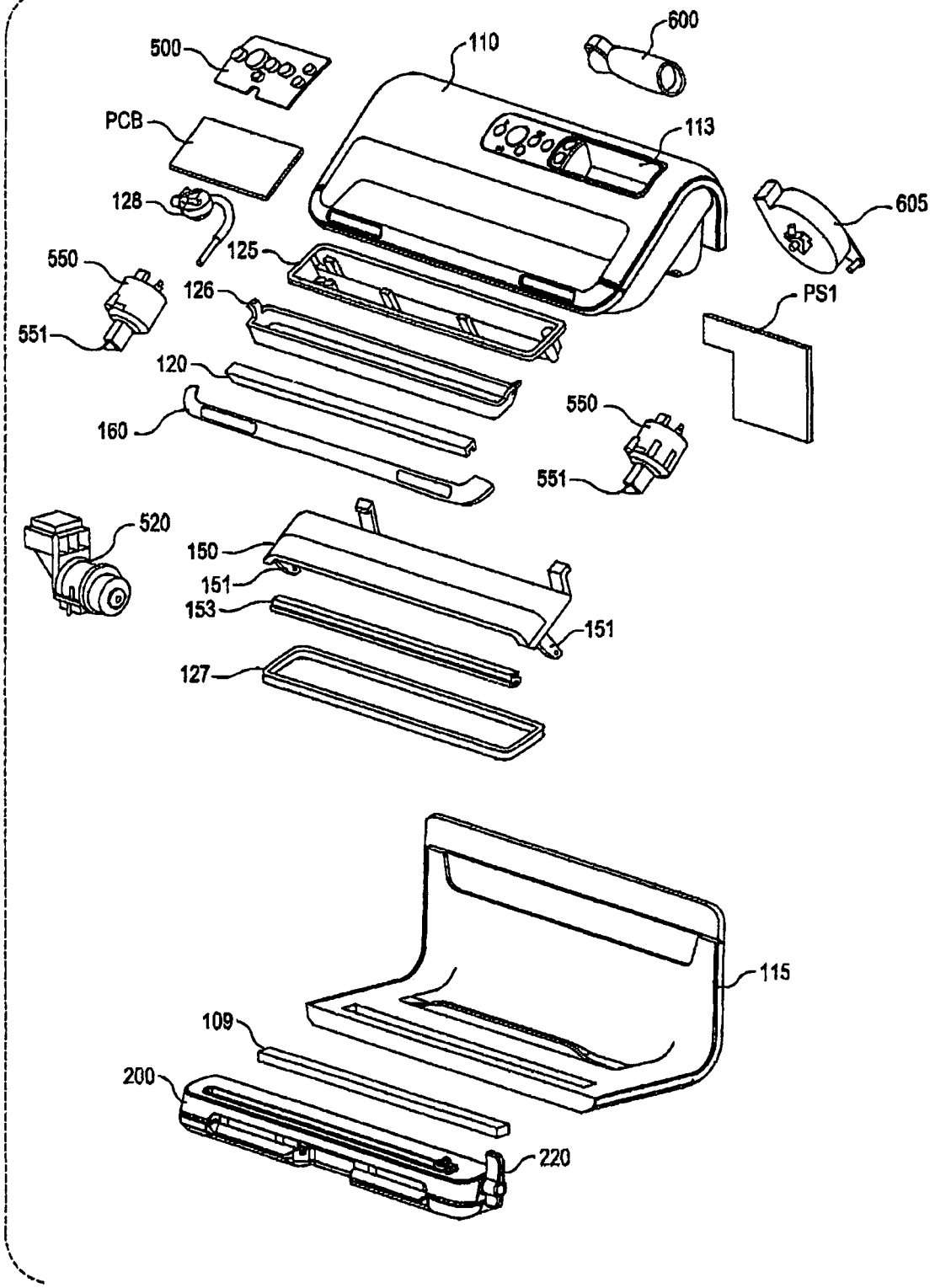
FIG. 8 is an exploded perspective view of the major components of the food storage appliance of FIGS. 1-5.
Figure 9:
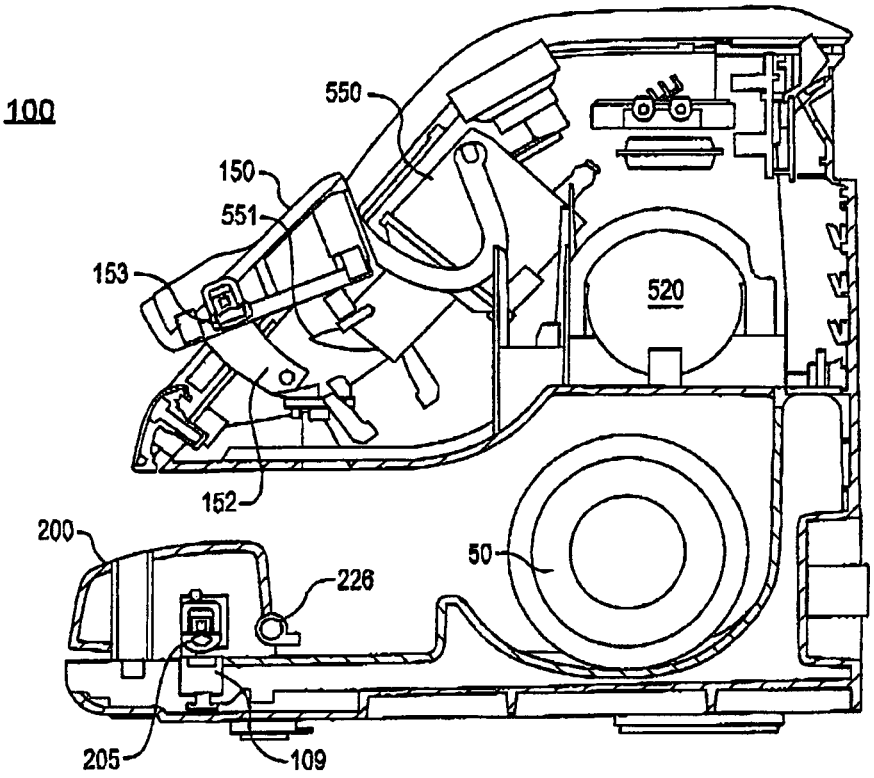
FIG. 9 is a cross-sectional view of the food storage appliance of FIGS. 1-5.

In an embodiment, the upper housing assembly 110 further includes an electronic control panel 500 including electronic controls for controlling the operation of operative electronic components including a first heat sealing element 109 disposed along a front edge of the horizontal portion 116 of the lower hosing assembly 115, a second heating element 120 disposed beneath a vacuum chamber 125, and a vacuum-motor assembly 520 (FIGS. 7-9). A transparent lid 150 (illustrated in the fully open position in FIG. 2) is pivotally attached to the upper housing assembly 110 that is moved to a fully closed position to cover and seal the vacuum chamber 125 during evacuating and heat sealing operations. The lid 150 is normally in a partially closed position (illustrated in FIG. 1) but is movable to the fully closed position (FIG. 5) by pneumatically activated cylinders 550 (FIGS. 7-9) during evacuating operations and heat sealing of the second end 52*b* of the food storage container 52. The vacuum-motor assembly 520 (FIGS. 7-9) provides suction to the vacuum chamber 125 via tubing (not shown) when energized as described more fully hereinbelow.

In an embodiment, an accessory wand 600 may be disposed adjacent the electronic control panel 500. The accessory wand 600 is adapted to connect to a port on non-flexible food storage containers (not shown) to evacuate them of food spoiling oxygen. The accessory wand 600 may be stored in a recess 113 (FIG. 8) adjacent the electronic control panel 500 and connected to the vacuum-motor assembly 520 via tubing (not shown). The tubing may be wound on a self-winding reel 605 (FIG. 8) disposed in the upper housing 110. One or more electronic controls may be provided on the electronic control panel 500 for controlling the operation of the accessory wand 600 as described more fully hereinbelow.

In an embodiment, the lower housing assembly 115 includes an elongated cutter bar assembly 200 pivotally attached to a front edge 116*a* (FIG. 10) of the horizontal portion 116 of the lower housing assembly 115 by a hinge assembly (described in more detail in the description of FIG. 10 below). The cutter bar assembly 200 is pivotal between a first position (FIG. 1) and a second position (FIG. 2). The cutter bar assembly 200 includes a sliding cutter 230 that can be moved back and forth along an elongated track 229 to cut a section of the food storage material from the roll 50 to form a single food storage container 52.

Referring now also to FIGS. 3 to 6, in an embodiment a rotating lever 220 is disposed on one end of the cutter bar assembly 200 for locking and unlocking the cutter bar assembly 200. For example, the cutter bar assembly 200 is unlocked and in the first position illustrated in FIG. 1 and it may be moved to the second position illustrated in FIG. 2 so that an unsealed end of the roll 50 may be positioned against a line L imprinted on the horizontal portion 116 in front of the first heating element 109 which positions the unsealed end perfectly for being heat sealed by the first heat sealing element 109.

Figure 4:
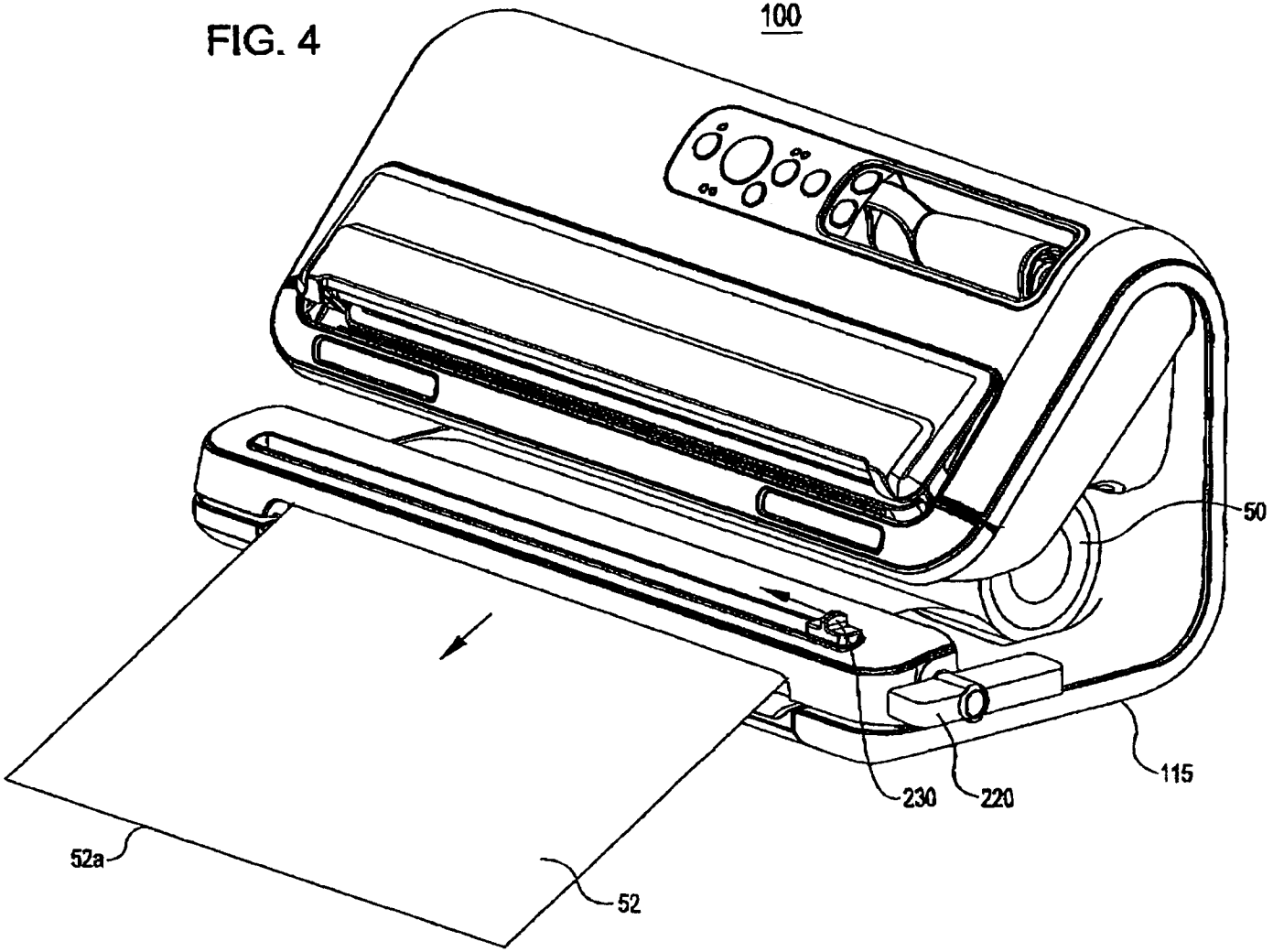
FIG. 4 is another perspective view of the food storage appliance of FIG. 3 with the lid in the partially closed position and the double-hinged cutter bar in a closed position so that the section of container material can be further extended from the cavity and cut from the roll of container material forming a food storage container with an unsealed end.

The cutter bar assembly 200 may now be moved back to the first position and then locked into the first position by rotating the lever 220 in a first direction to a locked position as illustrated in FIG. 4. The rotation of the lever 220 to the locked position automatically energizes the first heat sealing element 109 to heat seal the unsealed end 52*a* of the food storage container 52. An indicia 513 on the electronic control panel 500 may be lighted to indicate that the first heating element 109 has been energized. The first heat sealing element 109 is typically energized for a pre-determined time in the range of three to nine seconds but this is not meant to be limiting. The indicia 513 may be lighted to indicate the first heat sealing element 109 is energized during the pre-determined time and extinguished thereafter. The cutter bar assembly 200 may then be unlocked by rotating the lever 220 in a second direction to the unlocked position and moving the cutter bar assembly 200 to the first position illustrated in FIG. 1. This allows the section 52 of the food storage container material being unrolled from the roll 50 to be slid underneath the cutter bar assembly 200.

The cutter bar assembly 200 is also hinged on its rear edge to its base portion with a hinge 226 (FIG. 9) to allow a front edge of the cutter bar assembly 200 to be lifted to facilitate grasping and the sliding of the section 52 of container material underneath the cutter bar assembly 200 as illustrated in FIG. 4. The lever 220 may again be rotated in the first direction to the locked position illustrated in FIG. 4 to lock the cutter bar assembly 200 into the locked position and energizing the first heat sealing element 109 automatically. A switch SW1 (FIG. 7) adjacent to and in operative contact with the lever 220 completes the circuit from the electronic control panel 500 and the first heating element 109 when the lever 220 is rotated to the second position. Oppositely, the switch SW1 (FIG. 7) interrupts power being supplied to the first heat sealing element 109 when the lever is rotated to the first position.

The above sequence provides for the open end of another section 52' of the flexible container material of the roll 50 being pre-sealed prior to the previous section 52 being cut from the roll 50. After the first heat sealing element 109 has been energized for the pre-determined time to heat seal the open end of the next section 52', the lever 220 may be rotated in the second direction to the unlocked position illustrated in FIG. 1 to unlock the cutter bar assembly 220. The aforementioned previous section 52 of container material may then be cut from the roll 50 by moving the sliding cutter 230 back and forth along the track 229 forming a single food storage container 52 pre-sealed on one end 52*a* and unsealed an opposite end 52*b*.

Figure 5:
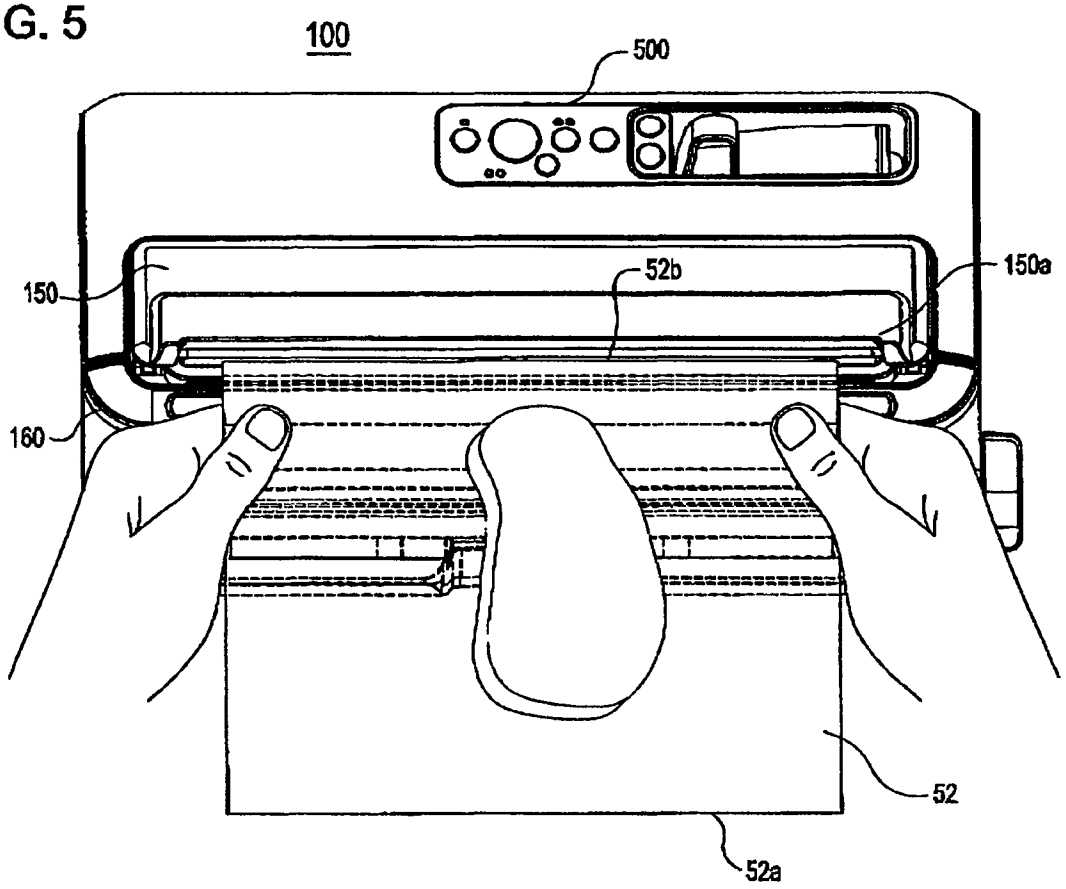
FIG. 5 is another perspective view of the food storage appliance of FIG. 4 with the lid in the fully closed position and the unsealed end of the food storage container inserted into the drip tray within the vacuum chamber.

Referring now in particular to FIG. 5, the perishable items desired to be preserved may be inserted into the food container 52 through the open end 52*b*. With the lid 150 in the normal partially closed position, the open end 52*b* is inserted into a removable drip tray 126 fitted in the vacuum trough 125 through a raised lip portion 150*a* of the lid 150. The drip tray 126 is for collecting fluids removed from the food storage container 52 during an evacuation and/or sealing operation and may be removed from the vacuum trough 125 for emptying and cleaning. Note that the lid 150 may be moved to the open position illustrated in FIG. 2 to remove and replace the drip tray 126 as necessary.

After the open end 52*b* of the food container 52 has been inserted into the removable drip tray 126 in the vacuum trough 125, a sealing or bumper bar 160 beneath the vacuum trough 125 may be depressed to begin the evacuation and heat sealing sequence of the food storage container 52. The bumper bar 160 is disposed beneath the vacuum trough 125 for convenience of the user. The evacuation and heat sealing sequence is commenced after the bumper bar 160 has been depressed and released to prevent inadvertent operation of the vacuum-motor assembly 520 and the second heat sealing element 120 in the event the bumper bar 160 is accidentally depressed when inserting the open end 52*b* of the food container 52 into the drip tray 126 and the vacuum trough 125.

In an embodiment, when the bumper bar 160 is depressed the operative electronic controls energize the vacuum-motor assembly 520 to provide pressurized air to a pair of pneumatically activated cylinders 550 disposed on opposing sides of the upper housing 110 in proximity to the vacuum trough 125. The exhaust from the vacuum-motor assembly 520 is routed through tubing (not shown) to provide pressurized air to the cylinders 550 which each include a piston (not shown) connected to an operative member or sliding rod 551 which engages a respective latch member 152 on opposing sides of the lid 150 and extending downwardly therefrom. As the sliding rods 551 are drawn into the interior of the cylinders 550, the respective latch member 152 is pulled drawing the lid 150 towards the upper housing 110 over the vacuum chamber 125 until it is seated in the fully closed position as illustrated in FIG. 5. The lid 150 in the fully closed position covers and seal the vacuum chamber 125 such that the food container 52 may be fully evacuated while the vacuum-motor assembly 520 is energized. After the lid 150 is moved to the fully closed position, a first solenoid valve (not shown) in the exhaust tubing (not shown) automatically opens diverting the exhaust from the vacuum-motor assembly 520 to the atmosphere. Almost simultaneously, a second solenoid valve (not shown) in the tubing (not shown) between the vacuum-motor assembly 520 and the vacuum trough 125 opens diverting suction from the vacuum-motor assembly 520 to the vacuum trough 125 which draws liquids and air in the food storage container 52 through the open end 52*b*. The vacuum-motor assembly 520 remains energized until a pre-determined level of pressure (for example, −15 in. Hg) is achieved in the vacuum chamber 125 as measured by a pressure sensor or transducer 128 (FIG. 8) operatively connected to the vacuum chamber 125 and the electronic control panel 500.

After a pre-determined time has elapsed after the vacuum-motor assembly 520 has been de-energized, the second heat sealing element 120 is automatically energized for a pre-determined time ("dry" seal only mode is three to eleven seconds, "moist" seal only mode is six to twelve seconds, "dry vacuum and seal" only mode is four to ten seconds, and "moist vacuum and seal" only mode is five to eighteen seconds) to heat seal the open end 52*b* of the food storage container 52. Finally, after the second heat sealing element 120 has been de-energized, a valve or port (not shown) on the cylinders 550 are opened electronically to vent the cylinders 550 to atmospheric pressure. The loss of pressure causes the cylinders 550 to retract the sliding rods 551 such that the latch members 152 are also released and the lid 150 returns to the normal partially closed position illustrated in FIG. 1. This completes one cycle of the food container 52 forming, cutting, evacuation and heat sealing cycle by the food storage appliance 100.

Figure 6:
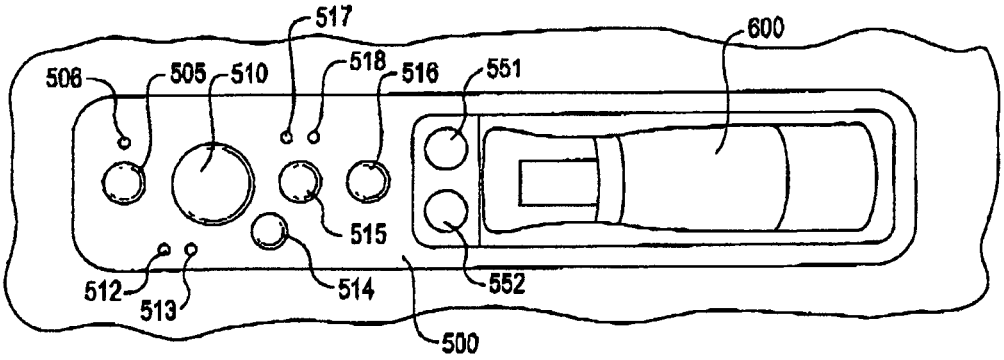
FIG. 6 is a top view of the electronic control panel of the food storage appliance of FIGS. 1-5.

Referring now also to FIG. 6, in an embodiment there is illustrated the electronic control panel 500 with some of the electronic controls for controlling various functions of the food storage appliance 100 and electronic components thereof. For example, the electronic control panel 500 may include a power "on" and "off" button or switch 505 and a lighted indicia 506 for indicating when electrical power is being provided to the control panel 500. The electronic control panel 500 may further include a "seal only" button 510 which is depressed to energize the second heat sealing element 120 when it is desired to manually heat seal the second end 52*b* of the food storage container section 52. There is also provided an associated lighted indicia 513 that is lighted when the first heat sealing element 109 is energized. The electronic control panel 500 may further include a "pulse vac" button 514 which is depressed to cause the vacuum-motor assembly 520 when energized to provide a user controlled suction to the vacuum chamber 125 to evacuate the food storage container 52 containing delicate food items that may otherwise be crushed. The electronic control panel 500 may include a "dry" or "moist" selection button 515 to control the pre-determined time the second heat sealing element 120 is energized depending on whether the food items in the food storage container 52 are dry or moist, i.e., the seal on the unsealed end 52*b* of the food storage container 52 requires less heat sealing time than moister foods which require a longer heat sealing time. There is associated lighted indicia 517, 518 that are lighted depending on the selection made by selection button 515. The electronic control panel 500 may further include an lighted indicia 512 that is lighted when the vacuum-motor assembly 520 is energized and a "cancel" button 516 which may be depressed at any time to cancel a pending or active evacuating and/or heat sealing operation. The electronic control panel 500 may further include an "accessory button" 551 which is depressed to activate the vacuum-motor assembly 200 and open a third solenoid valve (not shown) to provide suction to an accessory wand 600 for evacuating non-flexible food storage containers (not shown). The electronic control panel 500 may further include a "marinade" button 552 which is depressed to activate the vacuum-motor assembly 200 to provide a pre-determined number of evacuate, hold and release vacuum cycles to the accessory wand 600 for marinating a food product stored in a non-flexible food storage container (not shown).

Referring now also to FIGS. 7 and 8, other electronic components or controls may include a microprocessor M (not shown) mounted on a printed circuit board PCB with an operating control program stored in flash memory or ROM that controls the vacuum motor assembly 520, the heat scaling elements 109, 120, and other operative electronic components as discussed herein. The electronic components may also include other conventional components such as a power circuit PS1, an input interface circuit (not shown), an output interface circuit (not shown), and one or more storage devices ME (not shown), such as flash memory, a ROM (Read Only Memory) device and a RAM (Random Access Memory) device (not shown). The power circuit PS1 is connected to an AC or DC power source (not shown) and directs power to the motors, switches, sensors, solenoid valves, etc, described herein, as well as provide power to other circuits and components of the electronic controls 500. An input interface circuit may be electrically connected to the buttons 505, 510, 514, 515, 516, 551 and 552 for user control. An output interface circuit can be electrically connected to indicia 512, 513, 517 and 518 or a LCD screen (not shown). The storage device ME stores processing results and control programs that are run by the microprocessor circuit M (not shown) on the PCB. The electronic controls are capable of selectively controlling any of the vacuum motor assembly 520, the heat sealing elements 109, 120, first, second and third solenoid valves or other electronic components in accordance with the control program. It will be apparent to those skilled in the art from this disclosure that the precise structure and algorithms for the electronic control panel 500 can be any combination of hardware and software that will carry out the functions of the present invention.

Referring now also to FIG. 9, in an embodiment the lid 150 may include an elongated resilient bumper or seal profile 153. The seal profile 153 is comprised of an elastomer such as rubber or nylon. The seal profile 153 is mounted on the underside of the lid 150 with fasteners such as screws (not shown) or a heat sink bar (not shown) in front of a rectangular seal 127 which surrounds and seals vacuum chamber 125 when the lid 150 is in the fully closed position. The seal profile 153 facilitates evenly loading pressure across the end 52*b* of the food storage container 52 against the second heat sealing element 120 during heat sealing. A similar seal profile 205 is fastened (with fasteners such as screws or a heat sink bar which aren't shown) on the underside of the cutter bar assembly 200. The seal profile 205 facilitates evenly loading pressure across the end 52*a* of the food storage container 52 against the first heat sealing element 109 during heat sealing when the cutter bar assembly 200 is in the first and locked position and the lever 220 is in the locked position.

Figure 10:
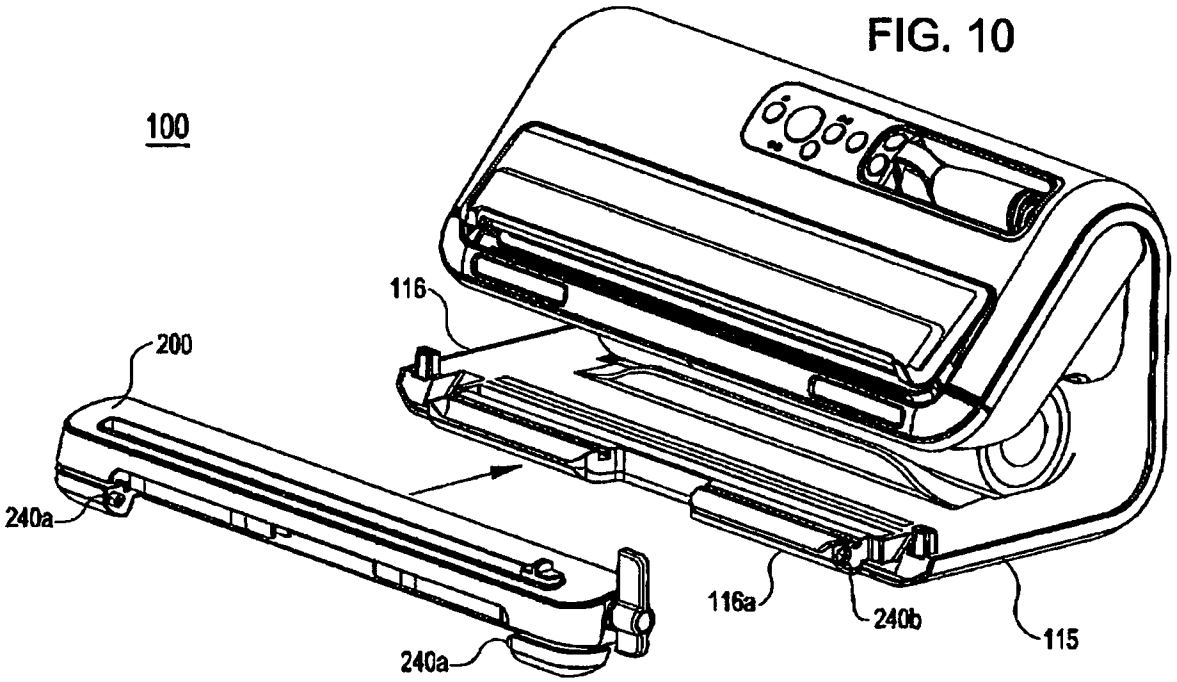
FIG. 10 is a partially exploded view of the food storage appliance of FIGS. 1-5 illustrating a hinged connection of the cutter-bar assembly to a front edge of the lower housing.

Referring now to FIG. 10, there is illustrated an embodiment of the hinge assembly pivotally connecting the cutter bar assembly 200 to the front edge 116*a* of the horizontal portion 116 of the lower housing assembly 115. The hinge assembly includes two opposing pins 240*a* disposed on the underside of the cutter bar assembly 200 that face inwardly towards one another. The pins 240*a* each engage a complementary socket 240*b* (only one seen in FIG. 10) disposed on opposing ends of a lip extending from the front edge 116*a* of the horizontal portion 116 of the lower housing assembly 115. The pins 240*a* and sockets 240*b* facilitate a pivoting action of the cutter bar assembly 200 relative to the lower housing assembly 115 from the first position illustrated in FIG. 1 to the second position illustrated in FIG. 2 and described more fully above.

The foregoing examples are not meant to be limiting as other possible modifications to the evacuating and sealing operations are possible.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A food storage appliance, comprising:

a housing containing operative components of the food storage appliance;

a first heat sealing element on a lower portion of the housing configured to heat seal a first end of a section of food storage container material forming a food storage container unsealed at a second end;

a vacuum chamber disposed in an upper portion of the housing connected to a vacuum-motor-assembly;

a second heat sealing element in the upper portion of the housing disposed adjacent to the vacuum chamber configured to heat seal the second end of the food storage container after being inserted into the vacuum chamber and being evacuated by suction from the vacuum-motor assembly, the second heat sealing element being independently operable relative to the first heat sealing element such that it is operable at the same time as the first heat sealing element;

a transparent lid covering the vacuum chamber movable between an open position for inserting the second end of the food storage container into the vacuum chamber and a closed position for evacuating the food storage container and heat sealing the second end;

at least one latch member on an underside of the lid; and at least one cylinder having an operative member configured to engage the latch member when the vacuum-motor assembly is energized, the latch member drawing the lid into the closed position and locking the lid against the housing during evacuation of the food storage container or heat sealing of the second end.

2. The food storage appliance of claim 1, further including:

the at least one cylinder fluidly connected to exhaust tubing of the vacuum-motor assembly to provide pressurized air to the at least one cylinder causing the operative member to engage the latch member and draw the lid into the closed position prior to evacuating the food storage container.

3. The food storage appliance of claim 1, further including:

a pair of latch members on the underside of the lid on opposing sides of the lid; and a cylinder associated with each latch member each having an operative member configured to engage the latch member when the vacuum-motor assembly is energized, the latch member drawing the lid into the closed position and locking the lid against opposing ends of the housing prior to evacuation of the food storage container and heat sealing of the second end.

4. The food storage appliance of claim 1, further including:

a removable drip tray fitted into the vacuum chamber for collecting liquid food dripping during evacuation of the food storage container.

5. The food storage appliance of claim 1, further including:

an elongated cavity formed in the housing for receiving a roll of food storage container material for supplying a continuous sheet of food storage container material that can be unrolled from the roll in sections for forming multiple food storage containers that are heat sealed by the first heat sealing element on the first end prior to being cut from the roll and heat sealed by the second heat sealing element on the second end after being cut from the roll.

6. The food storage container of claim 1, further including:

an elongated bumper bar disposed beneath the vacuum chamber on the upper housing which is depressed after the inserting the second end of the food storage container into the vacuum chamber to initiate evacuating the food storage container and heat sealing the second end.

7. The food storage container of claim 6, further including:

a circuit to delay initiating evacuating the food storage container and heat sealing the second end until after the bumper bar has been depressed and released.

8. A food storage appliance, comprising:

a housing containing operative components of the food storage appliance;

a first heat sealing element on a lower portion of the housing configured to heat seal a first end of a section of food storage container material forming a food storage container unsealed at a second end;

a vacuum chamber disposed in an upper portion of the housing connected to a vacuum-motor-assembly;

a second heat sealing element in the upper portion of the housing disposed adjacent to the vacuum chamber configured to heat seal the second end of the food storage container after being inserted into the vacuum chamber and being evacuated by suction from the vacuum-motor assembly, the second heat sealing element being independently operable relative to the first heat sealing element such that it is operable at the same time as the first heat sealing element;

a cavity being open on at least one end for insertion of the roll of food storage container material, the cavity formed by:

a lower housing assembly having a substantially planar horizontal portion for placement on a surface; and a substantially planar vertical portion attached perpendicular wise at a lower end to the horizontal portion, the upper housing attached cantilever fashion to an upper end of the vertical portion and extending over the cavity.

9. The food storage appliance of claim 8, the lower housing assembly further including:

A cutter bar assembly pivotally attached to a front edge of the lower housing assembly, the cutter bar assembly movable from a first position to a second position facilitating positioning of the first end of the section of food storage container material over the first heat sealing element prior to heat sealing and then movable back to the first position for facilitating heat sealing of the first end.

10. The food storage container of claim 9, further including:

a rotating lever on one end of the cutter bar assembly that is rotated a first time in a first direction after the cutter bar assembly is moved back to the first position configured to lock the cutter bar assembly into the first position to facilitate heat sealing the first end of the section of food storage material, and then rotated in a section direction opposite the first direction after heat sealing the first free end to release the cutter bar assembly from the first position so that the section of container material can be further extended from the lower housing, followed by moving the cutter bar assembly back to the first position and rotating the lever a second time in the first direction to lock the cutter bar assembly in the first position to facilitate cutting the section of food container material from the roll; and a sliding cutter movable back and forth along an elongated track formed in the cutter bar assembly, the sliding cutter bar having a blade that engages the section of food storage container material as the sliding cutter is moved back and forth along the track after the cutter bar assembly is moved to the first position and locked by rotating the lever in the first direction the second time.

11. The food storage container of claim 10, further including a switch that is normally open but is closed when the lever is rotated in the first direction automatically energizing the first heat sealing element to heat seal the first end of the section of container material.

12. A food storage appliance, comprising:

a housing;

a vacuum chamber;

a vacuum-motor assembly fluidly connected to the vacuum chamber for providing suction to the vacuum chamber when energized;

a lid movable between an open position and a closed position covering and sealing the vacuum chamber when the vacuum-motor assembly is energized; and at least one pneumatically activated cylinder connected to exhaust tubing of the vacuum-motor assembly, the cylinder having a sliding rod that is extended when pressurized air from the exhaust tubing is applied to the cylinder, the sliding rod engaging a latch member on the lid drawing and locking the lid over the vacuum chamber to seal the vacuum chamber.

13. The food storage appliance of claim 12, further including the at least one cylinder being two cylinders each having a sliding rod and each sliding rod engaging a respective latch member on the lid when pressurized air is applied to the exhaust tubing of each cylinder causing the lid to be drawn and looked over the vacuum chamber to seal the vacuum chamber.

14. The food storage appliance of claim 12, further including a port on the at least one cylinder for releasing pressurized air in the cylinder after the vacuum-motor assembly has been de-energized and causing the sliding rod to release the latch member to unlock the lid from the housing.

15. The food storage appliance of claim 14, further including delaying for a pre-determined time releasing the vacuum in the cylinder through the port after the vacuum-motor assembly has been de-energized to unlock the lid.

16. A food storage appliance, comprising:

a housing;

a vacuum chamber connected to a vacuum-motor-assembly;

a transparent lid pivotally mounted to the housing, the lid movable between an open position to insert a portion of a food storage container into the vacuum chamber and a closed position to seal the vacuum chamber facilitating evacuating the food storage container;

a first heat sealing element on a lower portion of the housing configured to heat seal a first end of a section of food storage container material forming a food storage container unsealed at a second end; and a second heat sealing element in an upper portion of the housing disposed adjacent to the vacuum chamber configured to heat seal the second end of the food storage container after being inserted into the vacuum chamber and being evacuated by suction from the vacuum-motor assembly, the second heat sealing element being independently operable relative to the first heat sealing element such that it is operable at the same time as the first heat sealing element.

17. The food storage appliance of claim 16, wherein the lid is pivotally mounted to the upper portion of the housing.

18. The food storage appliance of claim 16, further including at least one pneumatically operated cylinder that engages a latch member on the lid to draw the lid to a fully closed position when the vacuum-motor assembly is energized prior to evacuating the food storage container.

* * * * *